US009637901B2

(12) United States Patent
Oberholzer et al.

(10) Patent No.: US 9,637,901 B2
(45) Date of Patent: May 2, 2017

(54) METHOD FOR SETTING PARAMETERS

(71) Applicant: GEBERIT INTERNATIONAL AG, Jona (CH)

(72) Inventors: Roland Oberholzer, Uster (CH); Raffael Zingg, Wolfhausen (CH)

(73) Assignee: GEBERIT INTERNATIONAL AG, Jona (CH)

( * ) Notice: Subject to any disclaimer, the term of this patent is extended or adjusted under 35 U.S.C. 154(b) by 1149 days.

(21) Appl. No.: 13/647,789

(22) Filed: Oct. 9, 2012

(65) Prior Publication Data

US 2013/0086735 A1 Apr. 11, 2013

(30) Foreign Application Priority Data

Oct. 6, 2011 (EP) ..... 11184157
Sep. 14, 2012 (EP) ..... 12184472

(51) Int. Cl.
*E03D 1/14* (2006.01)
*E03D 5/10* (2006.01)

(52) U.S. Cl.
CPC ..... *E03D 5/105* (2013.01)

(58) Field of Classification Search
USPC ..... 4/305, 324
See application file for complete search history.

(56) References Cited

U.S. PATENT DOCUMENTS 5,187,818 A * 2/1993 Barrett, Sr. ..... E03D 5/105 4/304
2006/0010592 A1* 1/2006 Matsui ..... E03D 5/10 4/425
2006/0162788 A1 7/2006 Arigoni
2007/0113330 A1* 5/2007 Miller ..... E03D 5/10 4/319
2009/0106891 A1* 4/2009 Klicpera ..... B05B 12/004 4/605

FOREIGN PATENT DOCUMENTS

| | | | |
|---|---|---|---|
| AT | 009069 | U1 | 4/2007 |
| AT | 506791 | A4 | 12/2009 |
| DE | 31 40 307 | A1 | 8/1982 |
| DE | 3143446 | A1 | 5/1983 |
| DE | 4031776 | A1 | 4/1994 |
| DE | 19728019 | A1 | 2/1998 |
| DE | 20 2007 002 923 | U1 | 8/2008 |
| EP | 2034097 | A2 | 3/2009 |
| WO | 2008/046070 | A2 | 4/2008 |

* cited by examiner

*Primary Examiner* — Lauren Crane
(74) *Attorney, Agent, or Firm* — Sughrue Mion, PLLC

(57) ABSTRACT

A method for setting at least one parameter on an actuation element (1) for triggering a function, in particular flushing, on a sanitary system, wherein the actuation element (1) comprises at least two actuation sensors (2, 3) for detecting an input of a user and at least two optical display elements (4, 5). The actuation element (1) is transferred from an operating mode (B) into a setting mode (E), in which said parameters can be set, with the simultaneous activation of at least two actuation sensors (2, 3) over a preset time interval (T1).

24 Claims, 3 Drawing Sheets

METHOD FOR SETTING PARAMETERS

TECHNICAL FIELD

The present invention relates to a method for setting parameters on an actuation element for triggering a function on a sanitary system, such as for example for triggering the flushing of a toilet or a urinal according to the preamble of claim 1 and a device for the same according to the preamble of claim 11.

PRIOR ART

Actuation elements for triggering the flushing of toilets and urinals are known from the prior art. Such actuation elements have usually been constituted mechanically in the past, the user exerting a force on an actuating key and thus actuating a valve.

Furthermore, actuation elements of the aforementioned kind are known, which permit electronic triggering of flushing. For this, the actuation plate comprises for example a proximity sensor, which detects the presence of a person in front of the plate or the hand of a user triggering the flushing and thus triggers the flushing.

Such an actuation element is known for example from AT 009 069. The user can choose from a large number of different functions, wherein the actuation element displays the corresponding function to the user by indicating a signal in the form of a pictogram. A parameterisation of different settings is also permitted. A drawback with AT 009 069 is the fact that the parameterisation is extremely complicated and can be carried out only by the expert, i.e. for example the sanitary engineer, with the appropriate expertise. In addition, the nature of the parameterisation leaves no room for any modifications to the products, because the latter is based on permanently set pictograms.

Furthermore, the setting of the parameters is triggered in AT 009 069 by bringing the hand closer to or moving it away from the close vicinity of the sensor. The user therefore must always place his hand across corresponding boundaries of the active region of the sensor. To this extent, the user has to cross other boundaries here when setting different functions, which makes the setting complicated. In addition, the nature of the setting is very susceptible to incorrect manipulations.

DESCRIPTION OF THE INVENTION

Proceeding from the prior art, a problem underlying the invention is to provide a device and a method for setting parameters of an actuation element, wherein the method is intended to overcome the drawbacks of the prior art. In particular, the user is intended to be able to adjust a setting mode in a more straightforward manner and incorrect manipulations are intended to be prevented. Furthermore, the user should be able to set the parameters without having to undertake mechanical manipulations on the actuation plate.

Such a problem is solved by the method according to claim 1 and the device according to claim 11.

Accordingly, a method is used for setting at least one parameter on an actuation element for triggering a function on a sanitary system, such as for example the triggering of the flushing of a toilet or a urinal or the actuation of a water valve of a fitting, wherein the actuation element comprises at least two actuation sensors for detecting an input of a user and at least two optical display elements. The method comprises the step of transferring the actuation element from an operating mode into a setting mode, in which said parameters can be set, with the simultaneous activation of at least two actuation sensors over a preset time interval. Consequently, the actuation element is transferred from an operating mode into a setting mode, in which said parameters can be set, with the simultaneous activation of at least two actuation sensors over a preset time interval.

As a result of the joint actuation of two actuation sensors, the user is able to select the setting mode in a straightforward and reliable manner. An incorrect actuation can thus be ruled out.

The method also preferably comprises the step for changing the display configuration, in particular the colour, of at least one of the display elements, as soon as the actuation element has been transferred into the setting mode. The current state of the actuation element is thus displayed to the user.

The setting mode preferably comprises a large number of menu items, wherein, when the actuation element is in the setting mode, another menu item can be selected by a step for the activation of one of the at least two actuation sensors. The parameter assigned to a menu item can be set as a result of the step for the activation of the other of the at least two actuation sensors. Consequently, therefore, one actuation sensor is used to select the menu item, whilst the other actuation sensor is used to select a parameter that is assigned to the menu item.

The method also preferably comprises the step for changing the display configuration of a least one of the display elements during the change from one menu item to another menu item. An unequivocal display configuration, such as a colour for example, is preferably assigned to each of the menu items, so that the user can easily recognise the corresponding menu item.

The method also preferably comprises the step for changing the display configuration of at least one of the display elements during the change from one parameter to another parameter. An unequivocal display configuration, such as a colour for example, is preferably assigned to each of the parameters, so that the user can easily recognise the corresponding parameter.

The menu item is preferably displayed by one of the display elements, whilst the parameter is displayed by the other of the display elements. The user can thus always recognise the menu item in which the device finds itself at the time.

The method also preferably comprises the step for the storage of the selected parameter by activation of at least two of the actuation sensors after the setting of a parameter has taken place, wherein the display configuration of at least one of the display elements is changed, preferably briefly, in an optional step after the storage of the set parameter has taken place.

In the absence of activation of at least one of the actuation sensors over a preset time interval, the method preferably also comprises the step for transferring actuation device from the setting mode into the operating mode.

The settable parameter is preferably selected from the group comprising setting of the colour of the display elements, setting of the automatic flushing, setting of flushing water quantity, and/or setting of display functions of the display elements.

In a step for the simultaneous activation of at least two actuation sensors over a preset time interval, the actuation element is preferably transferred from an operating mode into a cleaning mode or from the cleaning mode into the operating mode, wherein the time interval for the selection of the cleaning mode is less than or greater than the time interval for the selection of the setting mode.

After the passage of a preset cleaning time interval, the method preferably also comprises the step for transferring the operating device from the cleaning mode into the operating mode.

Precisely two actuation sensors and precisely two display elements are preferably provided, wherein an actuation sensor is assigned in each case to a display element. The display elements preferably have a different size.

The method preferably also comprises the step for the deactivation of the triggering of said function, when the actuation element has been transferred into the setting mode or into the cleaning mode.

Further embodiments are given in the dependent claims.

An actuation element according to the invention is used for the triggering of a function, in particular flushing, on a sanitary system, wherein at least one parameter can be set on the actuation element, wherein the actuation element comprises at least two actuation sensors for detecting an input of a user and at least two optical display elements. With the simultaneous activation of at least two actuation sensors over a preset time interval, the actuation element can be transferred from an operating mode into a setting mode in a step for transferring the actuation element.

The actuation element preferably comprises a plate and the actuation sensors and/or the display elements are disposed behind the plate in the installed state.

The actuation element preferably also comprises a control device, which is connected to the actuation sensors and which can be transferred from the operating mode into the setting mode with simultaneous activation of at least two actuation sensors.

The control device is preferably also connected to the optical display elements and/or can be connected to the sanitary fitting, in particular via a cable, so that said function can be controlled.

The actuation sensors and the optical display elements are preferably disposed in pairs, wherein an actuation sensor lies in each case above a display element in the installed state.

Particularly preferably, precisely two actuation sensors and precisely two display elements are provided.

BRIEF DESCRIPTION OF THE DRAWINGS

Preferred embodiments of the invention are described below with the aid of the drawings, which serve merely for the purpose of clarification and are not to be interpreted as limiting. In the drawings.

DESCRIPTION OF PREFERRED EMBODIMENTS

Figure 1:
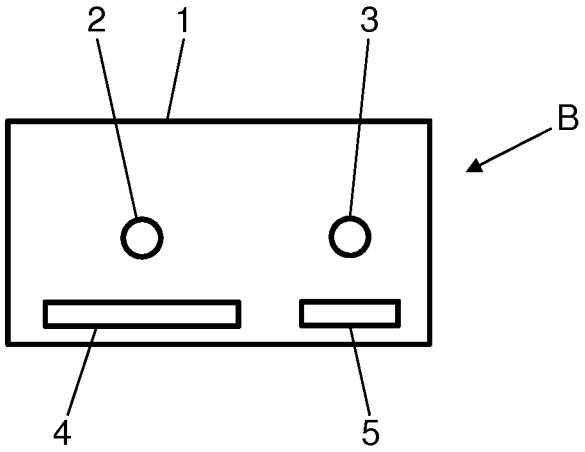
FIG. 1 shows a diagrammatic view of an actuation element of a sanitary system in the operating mode.
Figure 2:
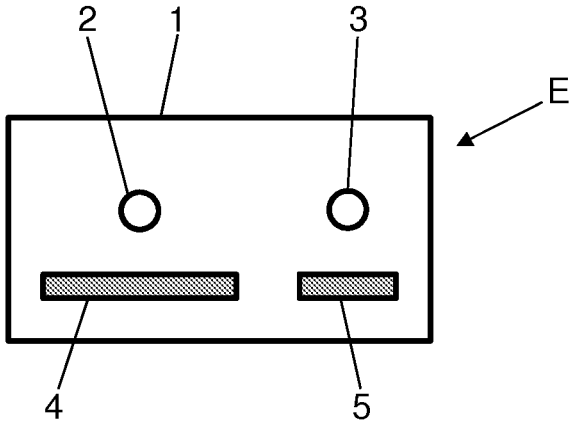
FIG. 2 shows the diagrammatic view of the actuation element according to FIG. 1 in the setting mode.
Figure 3:
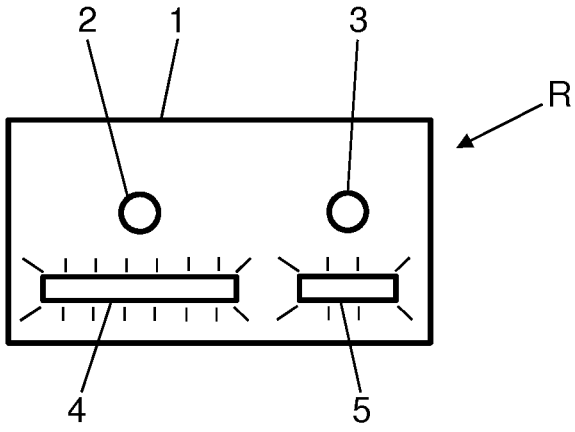
FIG. 3 shows the diagrammatic view of the actuation element according to FIG. 1 in the cleaning mode.

Diagrammatic views of an actuation element 1 are shown in FIGS. 1 to 3. Actuation element 1 is used to trigger a function in a sanitary fitting. If the sanitary fitting is a toilet or a urinal, the function is the flushing of the toilet or the urinal. If the sanitary fitting has the form of a washbasin tap, the function is the opening of the valve of the washbasin tap, so that water can flow through the tap into the washbasin.

Actuation element 1 essentially comprises at least two actuation sensors 2, 3 and at least two optical display elements 4, 5. Actuation sensors 2, 3 and optical display elements 4, 5 are connected together via a control device. The control device is also in contact with the sanitary fitting and thus controls the triggering of the said function, such as for example the opening of a valve. A power supply device is also provided, which supplies actuation sensors 2, 3, optical display elements 4, 5 and the control device with electrical energy. Parameters to be set can be stored by means of a storage device, which is part of the control device. Actuation element 1 preferably comprises precisely two actuation sensors 2, 3 and precisely two optical display elements 4, 5.

Actuation sensors 2, 3 are used to detect an input of a user and, viewed spatially, are disposed close to display elements 4, 5, wherein display elements 4, 5 signal to the user the location of the actuation. An actuation sensor and a display element always form of a corresponding pair. Here, actuation sensor 2 is assigned to display element 4 and actuation sensor 3 to display element 5. Display elements 4, 5 have here a different size, display element 4 being constituted larger than display element 5. The different size signals to the user that he can choose from two different functions. A differing function of this kind would for example be the choice of two different flushing water quantities. Thus, when actuation sensor 2 associated with large display element 4 is actuated, a greater quantity of flushing water is released than when actuation sensor 3 associated with small display element 5 is actuated.

Actuation sensors 2, 3 are for example infrared sensors, which are disposed behind a plate 6. Plate 6 is constituted in such a way that the latter is constituted permeable for the infrared rays of the infrared sensors.

Display elements 4, 5 essentially comprise an illuminant and can be duly controlled by the control unit. The control of the illuminant is a parameter which can be set by the user. The illuminants are preferably controlled in such a way that they turn on and are therefore visible to the user as soon as the latter approaches actuation element 1 or that the illuminants are always turned on. The illuminant is preferably one or more RGB light-emitting diodes. The use of other illuminants is also conceivable. Display elements 4, 5 are preferably disposed behind plate 6, the latter comprising light-permeable regions for display elements 4, 5.

Actuation element 1 can essentially assume three states according to FIGS. 1 to 3.

Operating mode B is shown in FIG. 1, wherein the user can trigger the appropriate function here. Display elements 4, 5 are turned on as soon as a user enters into the detection range of the sensors or are turned on permanently, so that the user can recognise the position of display elements 4, 5 and thus also the position of the actuation sensors. The operating mode is the standard mode.

Setting mode E is shown in FIG. 2, the display of display element 4, 5 differing here from that in operating mode B. For example, a different colour is displayed or display elements 4, 5 flash periodically.

Cleaning mode E is shown in FIG. 3. Here, display elements 4, 5 flash periodically and thus signal the cleaning mode. It would also be conceivable here for the cleaning mode to be displayed to the user in another colour.

With regard to display elements 4, 5, it should be pointed out that the display is different for all the states or modes, so that the user can recognise the state of actuation element 1 on the basis of the display by display elements 4, 5.

The method according to the invention is used for the setting of at least one parameter on the actuation element. For example, the setting of the colours of the display elements, the setting of the flushing function, the setting of the metering of the flushing water quantity and/or the setting of display functions of the display elements.

The method for setting at least one parameter on actuation element 1 for triggering a function on a sanitary system comprises the step of transferring actuation element 1 from an operating mode B into a setting mode E when at least two, preferably precisely two, of actuation sensors 2, 3 are activated over a preset time interval T1. In setting mode E, the user can then carry out appropriate settings on various parameters or also on only a single parameter. In order to transfer actuation element 1 into setting mode E, the user can, as shown in FIG. 3, hold both hands in front of actuation sensors 2, 3 and, after preset time interval T1 has been reached or exceeded, actuation element 1 is transferred from operating mode B into setting mode E. This kind of activation of setting mode E has the advantage that the user can very easily activate setting mode E. In particular, it is not necessary to repeatedly move the hands across the boundaries of the sensor. A further advantage is the fact that no separate sensors or switches have to be provided for this activation or the setting of parameters, but on the contrary actuation sensors 2, 3 provided for the triggering of the function on the sanitary system can be used directly.

Time interval T1 is preferably selected in the range from 7 to 15 seconds.

As soon as actuation element 1 has been transferred into setting mode E, the display configuration or the appearance of at least one of display elements 4, 5 is preferably changed. It is thus signalled to the user that actuation element 1 is now in setting mode E. The signalling via a change in the display configuration of at least one of display elements 4, 5 in turn has the advantage that no additional elements have to be provided for the display of the state of actuation element 1. The change in the display configuration can for example be a change in colour or a change in brightness of display elements 4, 5. Alternatively, a periodic activation and deactivation is also conceivable, which results in flashing of display elements 4, 5.

A possible method in respect of the setting of individual parameters is explained by reference to FIG. 4. Setting mode E comprises a large number of menu items M1, M2, M3. It can clearly be seen in FIG. 4 that menu items M1, M2, M3 can be selected after one another. When actuation element 1 is in setting mode E, another menu item can be selected by activation of one of the at least two actuation sensors 2. This activation is shown with reference symbol W in FIG. 4, wherein another menu item is selected by actuation or activation of left-hand actuation sensor 2.

First menu item M1 is preferably displayed directly after transferring actuation element 1 into setting mode E. By actuation of left-hand actuation sensor 2, the user can then select menu item M2 and, by a renewed actuation, menu item M3. With a renewed actuation, menu item M1 is again displayed to the user. Consequently, the user can select menu items M1, M2, M3 in a sequence and can navigate through the loop of menu items M1, M2, M3.

Assigned to each menu item M1, M2, M3 is a preset display configuration of display element 4, 5. The display configuration of at least one of the display elements thus also changes with a change from one menu item M1 to another menu item M2, as a result of which the user can recognise which menu item is displayed.

By activation of the other of the at least two actuation sensors 3, the user can then set the parameter assigned to a menu item M1, M2, M3. In FIG. 4, the user selects right-hand actuation sensor 3 for this, as is illustrated by reference symbol P. The user can then set various parameters by repeatedly selecting corresponding actuation sensor 3. The user can thus select the corresponding parameters in a similar manner to the selection of the menu item. A different display configuration, in particular a different colour, is assigned to each parameter of a menu item M1, M2, M3, wherein a different parameter can be displayed by repeated actuation of actuation sensor 3. If the parameter is for example the colour to be displayed by display elements 4, 5, the user can seek the desired colour by repeated actuation of actuation sensor 3, said colour being displayed by display elements 4, 5. Consequently, the display configuration of display elements 4, 5 changes with each actuation of actuation sensor 3, wherein in the case of the colour the display configuration corresponds to the colour.

If the parameter is for example the metering of the flushing water quantity, a display configuration, preferably a colour, is assigned to a corresponding metering quantity. The same applies to all the other parameters that are to be set or that can be set.

Menu item M1, M2, M3 is preferably displayed by one of the display elements, whereas parameter P is displayed by the other of the display elements. The user can thus always recognise the menu item in which the device currently finds itself and which parameter can be set.

When the user has found the parameter he is looking for, the latter is stored in a step for the storage by activation or actuation of at least two of actuation sensors 2, 3 after setting of a parameter has taken place. This is represented in FIG. 4 by reference symbol S. The parameter is written in the storage device. After the storage has taken place, a new menu item M1, M2, M3 or again the same menu item, the parameter whereof has just been stored, is displayed. Alternatively, after the storage has taken place, the device can also be transferred into the operating mode.

It can therefore be said that the method further comprises the step for storage S of the selected parameter by activation of at least two of actuation sensors 2, 3 after the setting or selection of a parameter has taken place.

In an optional step after storage S of set parameter P has taken place, the display configuration of at least one of display elements 4, 5 is changed, so that the storage is acknowledged by the user. A brief change, such as for example flashing of one or of both of display elements 4, 5, is preferable here.

As already explained above, the parameter to be set can be selected in very diverse ways. In particular, the parameter is preferably selected from the group comprising setting of the colour of the display elements, setting of the automatic flushing, setting of flushing water quantity, and/or setting of display functions of the display elements. Each of these parameters then represents a corresponding menu item.

The setting of the automatic flushing can comprise the activation of the automatic flushing or the deactivation of the automatic flushing. Automatic flushing is understood to mean that the flushing is triggered as soon as the actuation sensors detect a person in and the departure of a person from the radius of action of the actuation sensors.

In the case of the setting of the flushing water quantity, the user can set different flushing volumes.

The setting of the display functions is understood to mean, for example, various illumination modes, such as for example a permanent illumination or automatic illumination when a user enters into the radius of action of the actuation sensors.

In the absence of activation of at least one of actuation sensors 2, 3 over a preset time interval T3, actuation device 1 is transferred from setting mode E into operating mode B. This has the advantage that the device is again transferred into the normal operating mode in the event of an interruption of the setting operations without the latter being correspondingly blocked. Time interval T3 is preferably selected in a range from 10 to 30 seconds.

Figure 4:
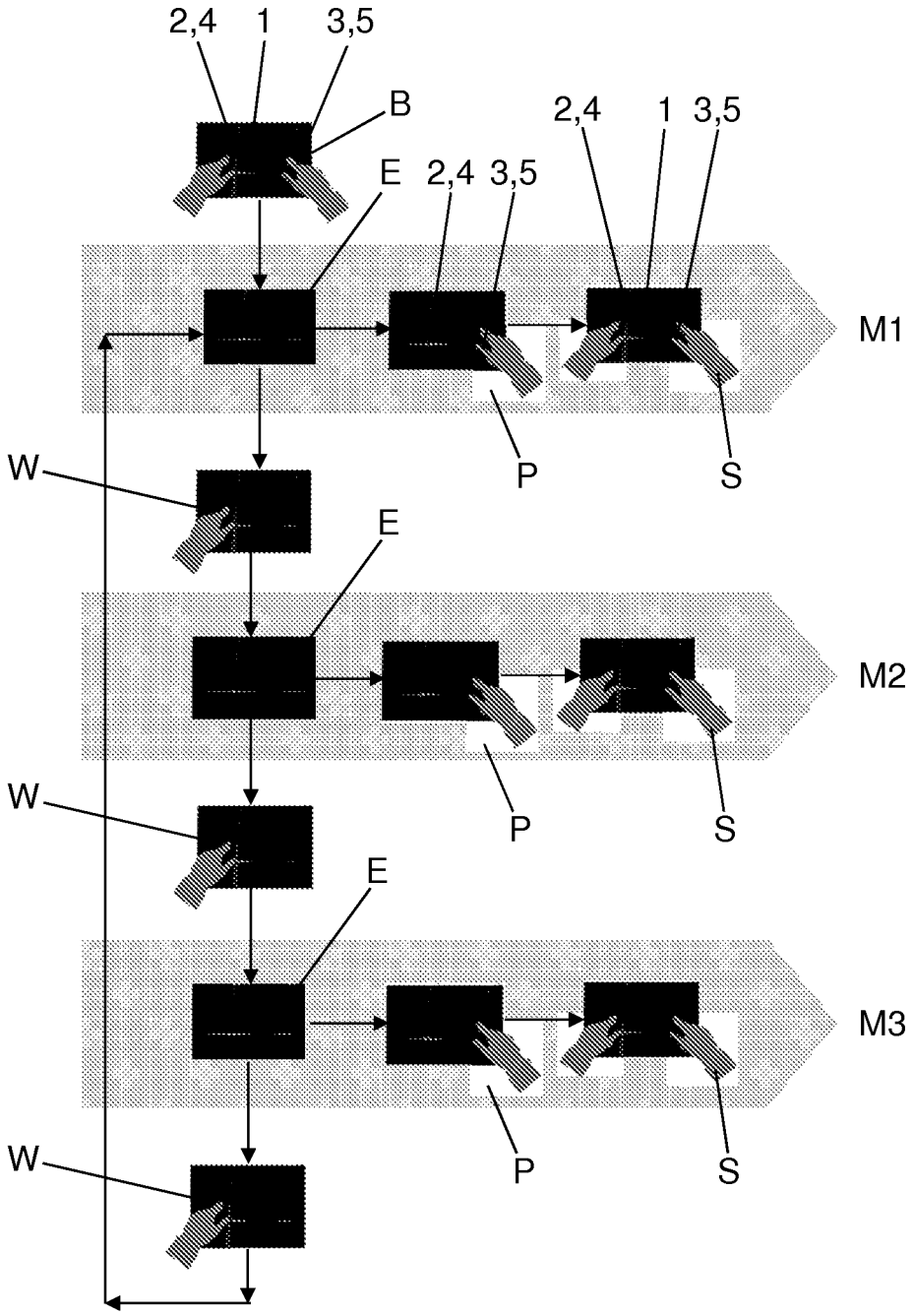
FIG. 4 shows the individual process steps according to a first embodiment.
Figure 5:
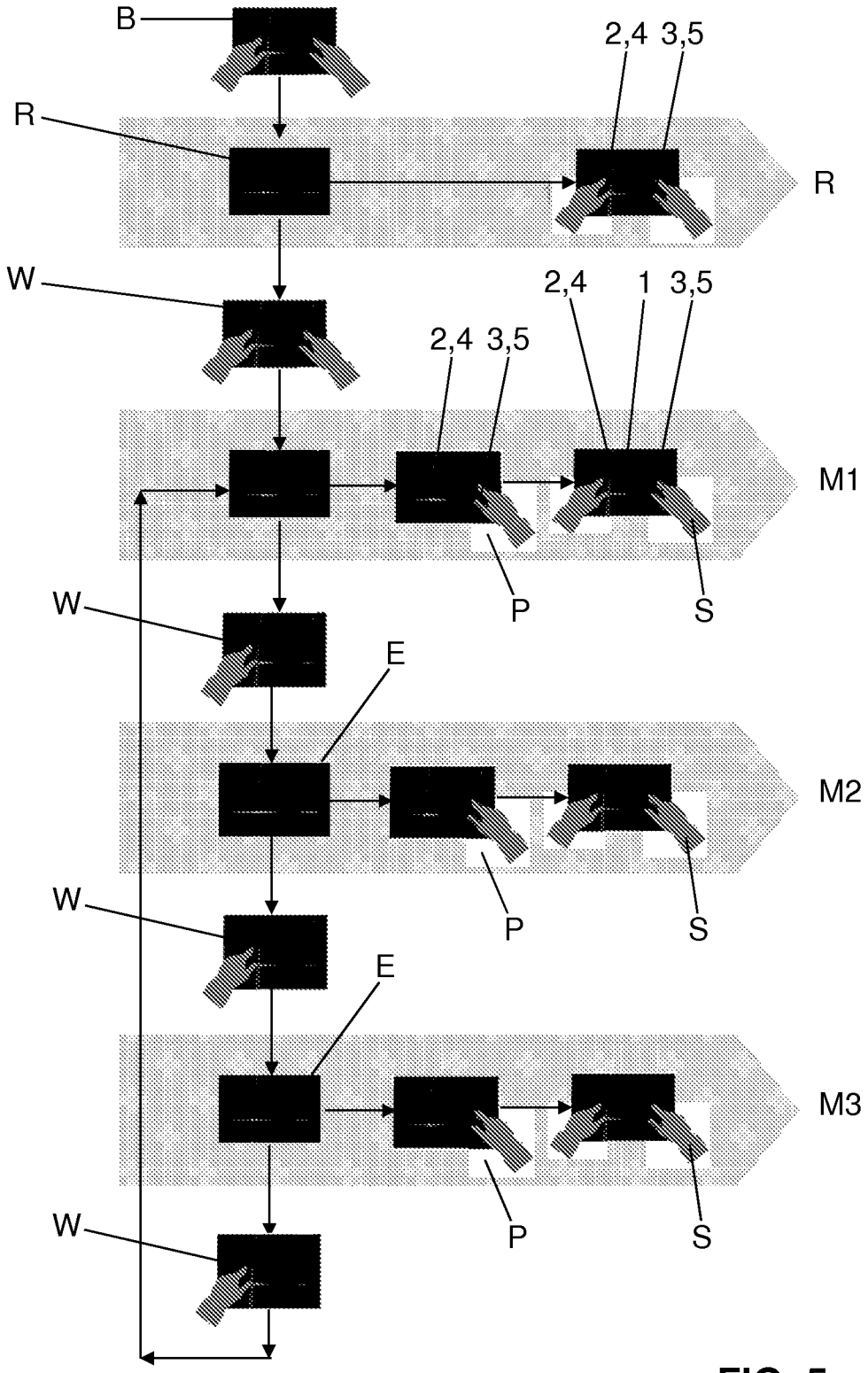
FIG. 5 shows the individual process steps according to a second embodiment.

The process sequence according to FIG. 4 is essentially shown in FIG. 5. In addition, cleaning mode R is also correspondingly represented here. Cleaning mode R can be activated via the step for the simultaneous activation of at least two actuation sensors 2, 3 over a preset time interval T2, wherein actuation element 1 is transferred from operating mode B into a cleaning mode R. Time interval T2 for the selection of cleaning mode R is less than or greater than time interval T1 for the selection of setting mode E. During the cleaning mode, the triggering of said function is rendered impossible. Time interval T2 preferably lies in the range from 2 to 6.5 seconds or in the range from 15.5 to 20 seconds.

At least one of display elements 4, 5 is preferably periodically activated and periodically deactivated when the actuation element is in cleaning mode R. It is thus indicated to the user that the device is in the cleaning mode.

After the passage of a preset cleaning time, preferably in the range from 10 to 30 seconds, the method further comprises the step for transferring actuation device 1 from cleaning mode R into operating mode B. The user does not therefore actively have to change the mode after the cleaning.

To sum up, it can be said that the method according to the invention has the advantage that the user can set a parameter on an actuation device of a sanitary system in a straightforward and reliable manner.

LIST OF REFERENCE NUMBERS

1 actuation element
2 actuation sensor
3 actuation sensor
4 display element
5 display element
B operating mode
E setting mode
P parameter
M1, M2, M3 menu items
S storage

The invention claimed is:

1. A method for setting at least one parameter on an actuation element for triggering a function on a sanitary system, wherein the actuation element comprises at least two actuation sensors for detecting an input of a user and at least two optical display elements, the method comprising:

transferring the actuation element from an operating mode into a setting mode, in which said parameters can be set, with the simultaneous activation of at least two actuation sensors over a preset time interval, wherein the setting mode comprises a number of menu items wherein, when the actuation element is in the setting mode, another menu item can be selected by a step for the activation of one of the at least two actuation sensors, and wherein the parameter assigned to the menu item can be set as a result of the step for the activation of the other of the at least two actuation sensors.

2. The method according to claim 1, wherein said function is a flushing of said sanitary system.

3. The method according to claim 1, wherein the method also comprises the step for changing the display configuration of at least one of the display elements as soon as the actuation element has been transferred into the setting mode.

4. The method according to claim 1, wherein said change in the display configuration is a change in color.

5. The method according to claim 1, wherein the method also comprises the step for changing the display configuration of at least one of the display elements with the change from one menu item to another menu item.

6. The method according to claim 5, wherein the method also comprises the step for changing the display configuration of at least one of the display elements with the change from one parameter to another parameter.

7. The method according to claim 1, wherein the method also comprises the step for the storage of the selected parameter by activation of at least two of the actuation sensors after the setting of a parameter has taken place, wherein the display configuration of at least one of the display elements is changed in an optional step after the storage of the set parameter has taken place.

8. The method according to claim 1, wherein in the absence of activation of at least one of the actuation sensors over a preset time interval, the method also comprises the step for transferring the actuation device from the setting mode into the operating mode.

9. The method according to claim 1, wherein the settable parameter is from the group comprising setting of the color of the display elements, setting of the automatic flushing, setting of flushing water quantity, and/or setting of display functions of the display elements.

10. The method according to claim 1, wherein in a step for the simultaneous activation of at least two actuation sensors over a preset time interval, the actuation element is transferred from an operating mode into a cleaning mode or from the cleaning mode into the operating mode, wherein the time interval for the selection of the cleaning mode is less than or greater than the time interval for the selection of the setting mode.

11. The method according to claim 10, wherein the display elements are periodically activated and periodically deactivated when the actuation element is in cleaning mode.

12. The method according to claim 10, wherein after the passage of a preset cleaning time, the method further comprises the step for transferring actuation device from cleaning mode into the operating mode.

13. The method according to claim 1, wherein the time interval for the activation of the setting mode is in the range from 7 to 15 seconds and/or wherein the time interval for the activation of the cleaning mode lies in the range from 2 to 6.5 seconds or in the range from 15.5 to 20 seconds and/or wherein the cleaning time interval lies in the range from 10 to 30 seconds.

14. The method according to claim 1, wherein the method comprises the step for deactivating the triggering of said function, when the actuation element has been transferred into the setting mode or into the cleaning mode.

15. An actuation element for triggering a function on a sanitary system, wherein at least one parameter related to the function can be set on the actuation element, comprising:

a microprocessor, at least two actuation sensors for detecting an input of a user, and at least two optical display elements, wherein, with the simultaneous activation of at least two actuation sensors over a preset time interval, the actuation element can be transferred from an operating mode into a setting mode in which said at least one parameter can be set, wherein the setting mode comprises a number of menu items wherein, when the actuation element is in the setting mode, another menu item can be selected by activation of one of the at least two actuation sensors, and wherein the parameter assigned to the menu item is set as a result of the activation of the other of the at least two actuation sensors.

16. The actuation element according to claim 15, wherein said function is flushing of a sanitary system.

17. The actuation element according to claim 15, wherein the actuation element comprises a plate and wherein the actuation sensors are disposed behind the plate in the installed state.

18. The actuation element according to claim 15, wherein the actuation element comprises a plate and wherein the display elements are disposed behind the plate in the installed state.

19. The actuation element according to claim 15, wherein the actuation element also comprises a control device, which is connected to the actuation sensors and which can be transferred from the operating mode into the setting mode with simultaneous activation of at least two actuation sensors.

20. The actuation element according to claim 15, wherein the control device is also connected to the optical display elements and/or wherein the control device can be connected to the sanitary fitting, in particular via a cable, so that said function can be controlled.

21. The actuation element according to claim 15, wherein the actuation sensors and the optical display elements are disposed in pairs, wherein an actuation sensor lies in each case above a display element in the installed state.

22. The actuation element according to claim 15, wherein precisely two actuation sensors and precisely two display elements are provided.

23. A sanitary system comprising an actuation element according to claim 15, wherein the sanitary system further comprises a cistern with an outflow opening and a valve closing the outflow opening, wherein the valve can be actuated with the actuation element, or wherein the sanitary system also comprises a water valve and a fitting, wherein the water valve can be actuated with the actuation element.

24. The method according to claim 1, wherein said simultaneous activation occurs at the same moment in time during said preset time interval.

* * * * *